US006731074B2

(12) United States Patent
Suzuki

(10) Patent No.: US 6,731,074 B2
(45) Date of Patent: May 4, 2004

(54) ELECTRODE-LESS LAMP EQUIPMENT

(75) Inventor: Akio Suzuki, Tokyo (JP)

(73) Assignee: ORC Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/143,742

(22) Filed: May 10, 2002

(65) Prior Publication Data

US 2003/0209995 A1 Nov. 13, 2003

(51) Int. Cl.[7] ..... H05B 41/16

(52) U.S. Cl. ..... 315/248; 315/118; 315/344; 315/39.51

(58) Field of Search ..... 315/248, 246, 315/39.51, 344, 267, 118

(56) References Cited

U.S. PATENT DOCUMENTS 4,504,768 A * 3/1985 Ury et al. ..... 315/248
5,039,918 A * 8/1991 Ohtake et al. ..... 315/248
5,838,108 A * 11/1998 Frank et al. ..... 315/39
6,445,138 B1 * 9/2002 Barry et al. ..... 315/248

FOREIGN PATENT DOCUMENTS

| | | |
|---|---|---|
| JP | 2-117003 | 5/1990 |
| JP | 4-131853 | 12/1992 |
| JP | 2001-126504 | 11/2001 |

* cited by examiner

*Primary Examiner*—James Clinger
*Assistant Examiner*—Ephren Alemu
(74) *Attorney, Agent, or Firm*—Dellett & Walters

(57) ABSTRACT

An electrode-less lamp equipment with higher luminance by higher lamp-cooling efficiency wherein the airflow generated by the blower 9 goes through the ventilation hole 12 and spouts out from the open end of the lamp-cooling nozzle 15 and cools the surface of the electrode-less lamp 1 is provided. The velocity of the airflow is accordingly high around the lamp surface enough to efficiently cool the lamp. This makes it possible to raise the input power density to the lamp and to increase luminance.

4 Claims, 6 Drawing Sheets

ELECTRODE-LESS LAMP EQUIPMENT

FIELD OF INVENTION

This invention intends to enhance luminance of electrode-less lamp by improving lamp-cooling efficiency that shines in a microwave electromagnetic field and to provide with electrode-less lamp equipment with the lamp.

BACKGROUND OF INVENTION

This kind of electrode-less lamp equipment by former arts is known for example such as those in Japan Patent Bulletins Tokukai-Hei 2-117003 and Jitsukai-Hei 4-131853. FIGS. 7 and 8 show an example of electrode-less lamp equipment by current arts. FIG. 7(*a*) shows a longitudinally cut cross-section view and FIG. 7(*b*) shows a partially cut plane view from the bottom. FIG. 8 shows a vertical section view that shows the coupling of a microwave-generating source, a waveguide, and a microwave chamber.

This electrode-less lamp equipment is furnished with an electrode-less lamp 1 of a glass tube made from crystal in which light-emission material such as mercury is enclosed. The electrode-less lamp 1 is fixed in a microwave chamber 2. The microwave chamber 2 consists of a box-shaped metal chamber wall 3 with an open port at the bottom and a mesh 4 at the open port of the chamber wall 3.

A light-beam-collection mirror 8 is settled in the microwave chamber 2 by which the light beam emitted from the electrode-less lamp 1 is collected and is guided toward the open port of the microwave chamber 2. The light-beam-collection mirror 8 consists of a concave mirror of half-split tube with a side section of half ellipse. The electrode-less lamp 1 and the light-beam-collection mirror 8 are arranged and fixed on the chamber wall 3 so that the light-beam-collection mirror 8 is positioned at the focus point of the ellipse.

The bottom end of the waveguide 6 is fixed at the exterior surface of the upper end of the microwave chamber 2 and the microwave generating source 5 consisting of two magnetrons is fixed at the upper end of the waveguide 6. On the opposite side of the waveguide 6, the lower end of which extends an antenna 7 into the microwave chamber 2. The antenna 7 is arranged between the electrode-less lamp and the light-beam collection mirror 8, in parallel with the light-beam collection mirror 8. One end of the antenna 7 is connected to the chamber wall 3 and the other end is connected a coaxial waveguide converter (not present in the Figures) in the waveguide 6 through antenna through-holes 10 and 11. For convenience of notation, FIG. 7(*b*) omitted the antenna through-holes 10 and 11. Furthermore for simplicity, in FIG. 7(*a*), at only one side are numbered the elements of the symmetric devices such as waveguide 6.

A blower 9 is equipped with at the upper side of the waveguide 6. The waveguide 6 and the microwave chamber 2 have ventilation holes 12 and 13 respectively at the upper ends. Around the bottom of the concave of the light-beam-collection mirror 8 that is at the opposite end against the open end of the light-beam-collection mirror 8, are formed ventilation holes 14. The components above described are settled in a case 16 that is uniformly configured with the chamber wall 3. In the electrode-less lamp equipment above described, the microwave generated with the microwave-generating source 5 is induced to the microwave chamber 2 through waveguide 6 and antenna 7 and is reflected in the microwave chamber 2 and excites the enclosed gas such as mercury and produces plasma in the electrode-less lamp, which results in emission of light including ultraviolet. The light beam is collected with the beam-collection mirror 8 and focuses on the beam-collection surface FP that is another focus point of the ellipse. The airflow sent by the blower 9 follows the arrow in FIG. 8 through the ventilation holes 12, 13, and 14 then cools the electrode-less lamp 1.

However, in the electrode-less lamp equipment by the former arts, a restricted durability of the mirror surface against heat and an optical disadvantage that the beam-collection mirror 8 needs high magnification if the distance between the focus point and the ellipse bottom is short prevented closer setting of the beam-collection mirror 8 to the electrode-less lamp 1. Accordingly, the airflow emitted through the ventilation hole 14 on the beam-collection mirror 8 slowed down around the electrode-less lamp 1, which reduced the cooling efficiency and resulted in low input density to the lamp and low luminance. This invention intends to solve the problems above described and to raise lamp luminance by improving the lamp cooling efficiency and to provide with electrode-less lamp equipment.

SUMMARY OF INVENTION

Electrode-less lamp equipment in this invention is comprising ventilation nozzles for airflow that cool the electrode-less lamp in the electrode-less lamp equipment consisting of a microwave-generating source, a microwave chamber receiving the microwave from the microwave-generating source, a bar-shaped electrode-less lamp in the microwave chamber, and a half-cut cylinder-shaped concave mirror that collects the light beam from the lamp. This nozzle may be set closer to the electrode-less lamp than the ventilation holes of the equipment by the former arts might be set. The close setting of the nozzle improved lamp-cooling efficiency and enabled higher input density resulting in higher luminance or in less airflow if the luminance is not increased.

DESCRIPTION OF THE PREFERRED EMBODIMENT (The Best Embodiment)

Figure 1:
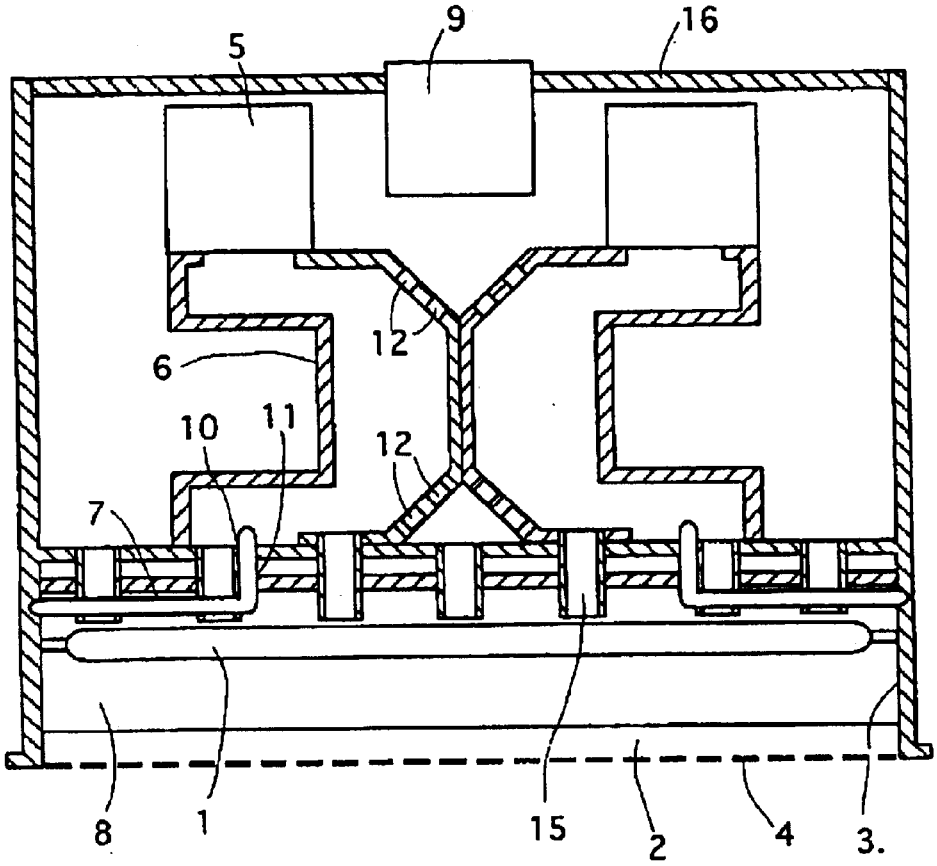
FIG. 1 shows a side-section view of the longitudinally cut electrode-less lamp equipment in Embodiment of this invention.
Figure 2:
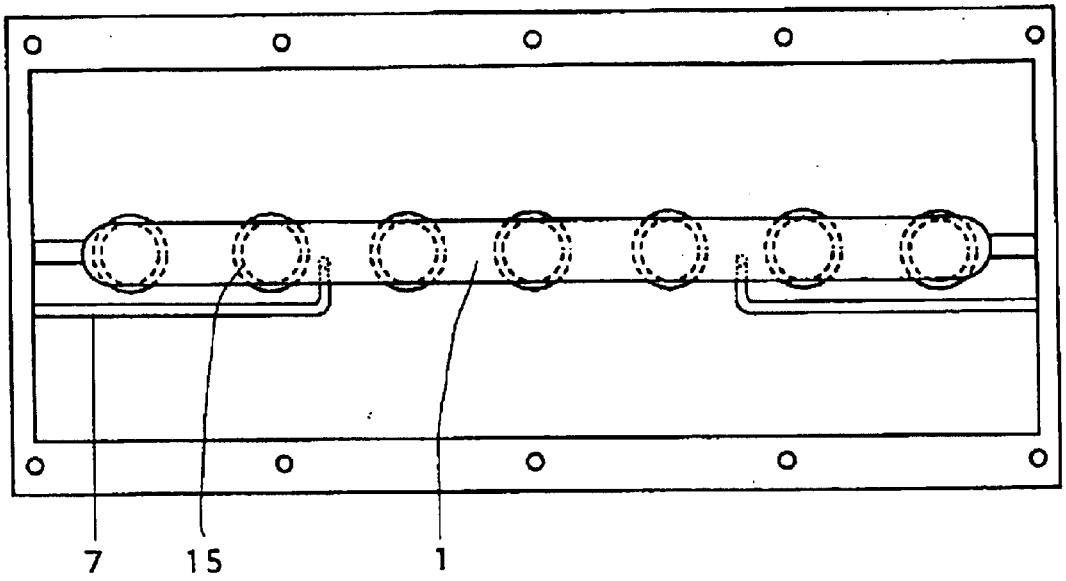
FIG. 2 shows an outline plan in bottom view of the electrode-less lamp equipment in Embodiment of this invention.

In the Embodiment of this invention, as shown in FIGS. 1, 2, and, 3, an electrode-less lamp 1 that consists of a cylinder-shaped glass tube of crystal or the like in which an emission material like mercury is enclosed is fixed in a microwave chamber 2. The microwave chamber 2 consists of a chamber wall 3 of box shape with an open port at the bottom and a mesh 4 fixed at the open port of the chamber wall 3. A light-beam collection-mirror 8 is settled in the microwave chamber 2 that collects the light beams from the electrode-less lamp 1 and induces it to the open port of the microwave chamber 2. The light-beam-collection mirror 8 consists of a concave mirror of half-split cylinder with a side section of half ellipse. The electrode-less lamp 1 and the light-beam-collection mirror 8 are arranged and fixed on the chamber wall 3 so that the light-beam-collection mirror 8 is positioned at the focus point of the ellipse.

The bottom end of the waveguide 6 is fixed at the exterior surface of the upper end of the microwave chamber 2 and the microwave generating source 5 consisting of two magnetrons is fixed at the upper end of the waveguide 6. On the opposite side of the waveguide 6, the lower end of which extends an antenna 7 into the microwave chamber 2. The antenna 7 is arranged between the electrode-less lamp 1 and the light-beam-collection mirror 8, in parallel with the light-beam-collection mirror 8. One end of the antenna 7 is connected to the chamber wall 3 and the other end is connected to a coaxial waveguide converter (not present in the Figures) in the waveguide 6 through antenna through-holes 10 and 11.

A blower 9 is equipped with at the upper side of the waveguide 6. The waveguide 6 and the microwave chamber 2 have ventilation hole 12. From the upper surface of the chamber wall 3 of microwave chamber 2 or from the bottom surface of the waveguide 6 where the waveguide 6 is fixed, passing through the bottom of the concave of the light-beam-collection mirror 8, several air nozzles 15 to cool the lamp are settled.

These air nozzles 15 to cool the lamp are extended straight downward and the spouting open end reaches around the exterior surface of the lamp 1. The material for these air nozzles is demanded to be transparent for light beams and microwaves like transparent crystal glass. Those components described above are settled in a case 16 formed together with the chamber wall 3.

Figure 3:
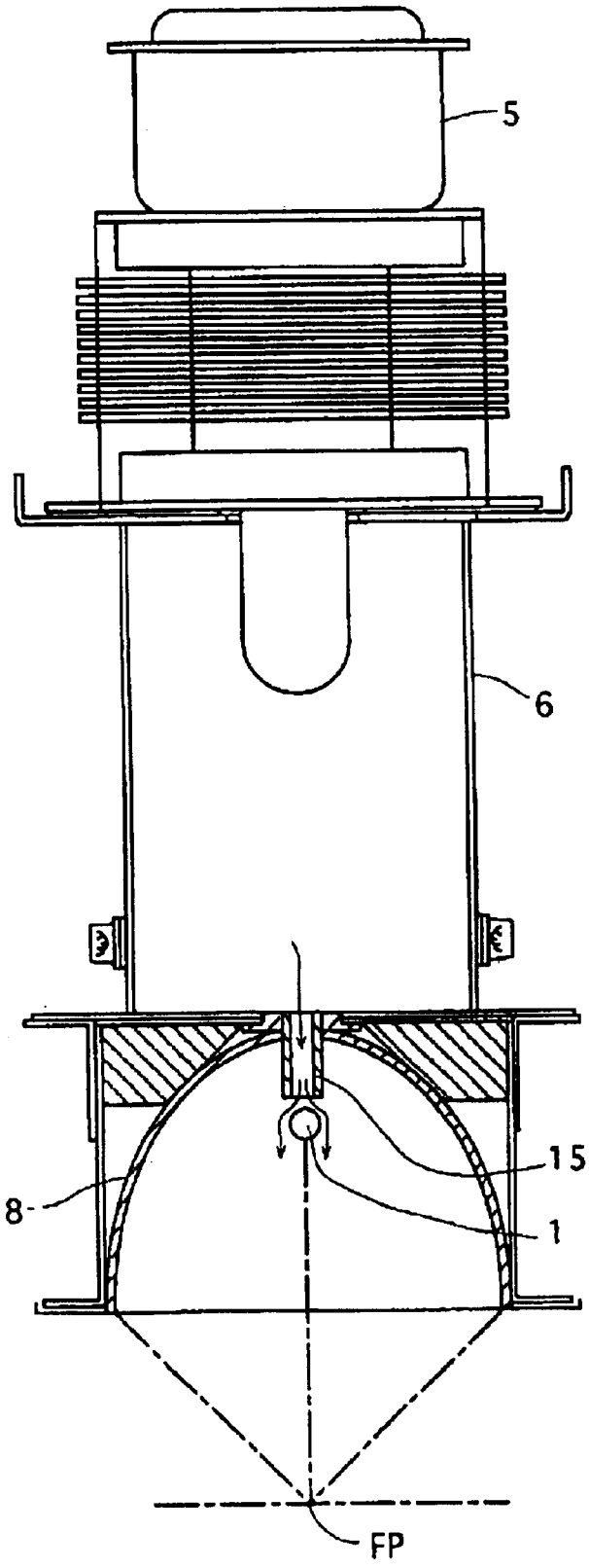
FIG. 3 shows coupling relationship between a microwave generating source, a waveguide, and a microwave chamber of the electrode-less lamp equipment in Embodiment of this invention.

In the electrode-less lamp equipment above described, the microwave generated with the microwave generating source 5 is guided to the microwave chamber 2 through waveguide 6 and produces plasma in the electrode-less lamp, which results in light emission including ultraviolet. The light beam is collected with the beam-collection mirror 8 and focuses on the beam collection surface FP below the bottom open port of the microwave chamber 2, which is the same as in the equipment by the former arts. The airflow generated by the blower 9 goes through ventilation hole 12 as shown in the arrow in FIG. 3 and spouts out from the open end of the lamp cooling nozzle 15 and cools the surface of the electrode-less lamp 1. The velocity of the airflow is accordingly is high around the lamp surface enough to efficiently cool it, which enables high input power density to the lamp and increases luminance.

Figure 4:
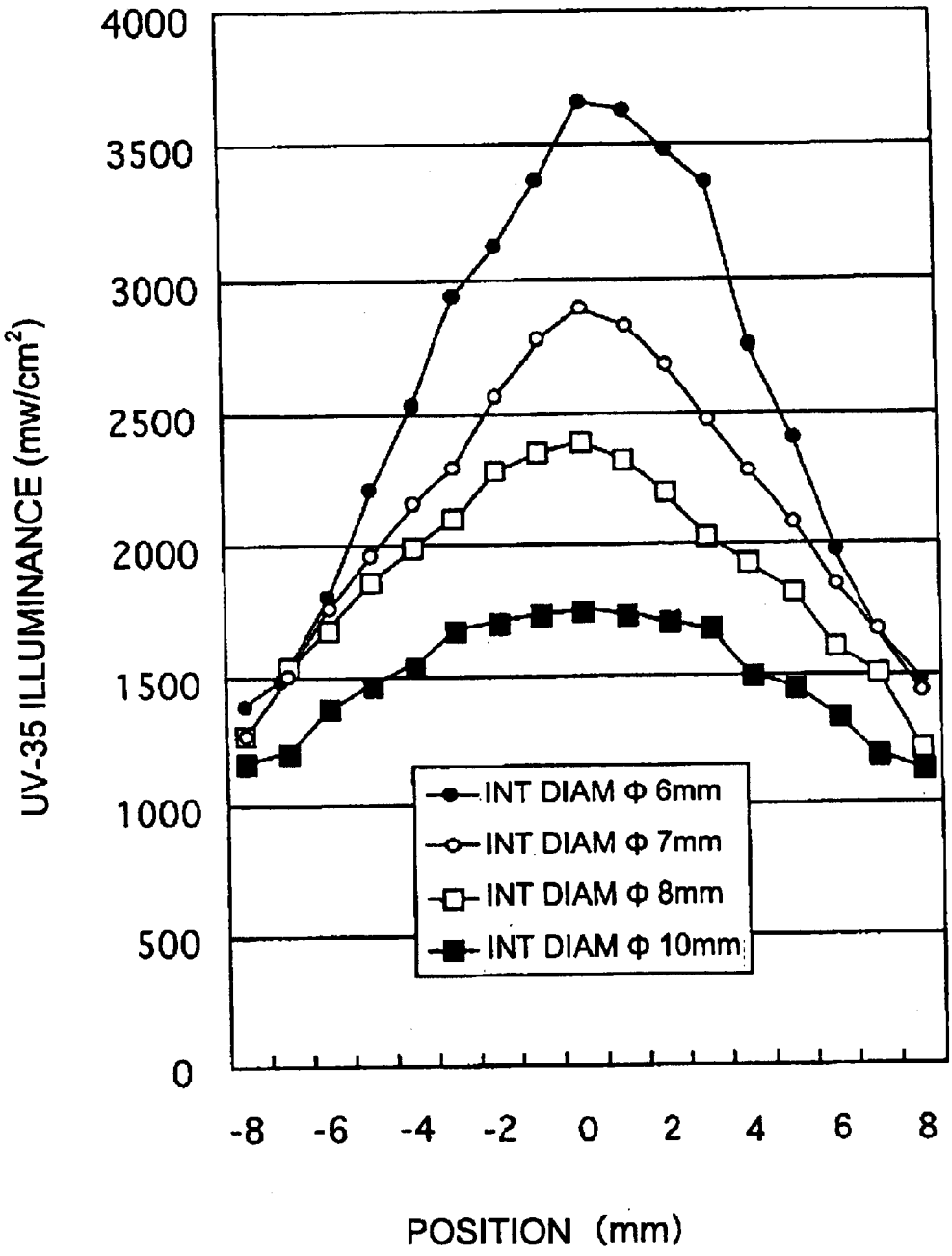
FIG. 4 shows a performance curve that explains the effects in Embodiment in this invention.

FIG. 4 shows a performance curve with experimental data to explain the effects of the Embodiment in this invention. The data are collected with an experiment setup of electrode-less lamp equipment consisting of 2 magnetrons as microwave generator with 6 kW microwave power altogether. An illuminance profile is measured with respect to cylinder's interior diameter of the electrode-less lamp equipment setup. As shown in FIG. 4, the illuminance peak at the light-beam collection face with the light-beam-collection mirror is increased inversely proportional to the cylinder's interior diameter when the diameter is varied. However, the lamp wall load, that is, the power per unit area absorbed into the interior wall of the lamp is raised high which needs a proper cooling means.

As far as the cooling means of the equipment by the former arts, the cylinder's interior diameter was limited at least 8 mmϕ by the condition that the cylinder is not damaged with the heat. This invention cleared this condition and made the diameter of 6 mmϕ possible at stable operating condition, which resulted in 1.5 times peak illuminance at the beam collection face.

(Another Embodiment)

Although the Embodiment described above adopts a linear shaped antenna 7, the antenna with waveform disclosed in Japan Patent Bulletin Tokukai 2001-126504 may be adopted as well.

Figure 5:
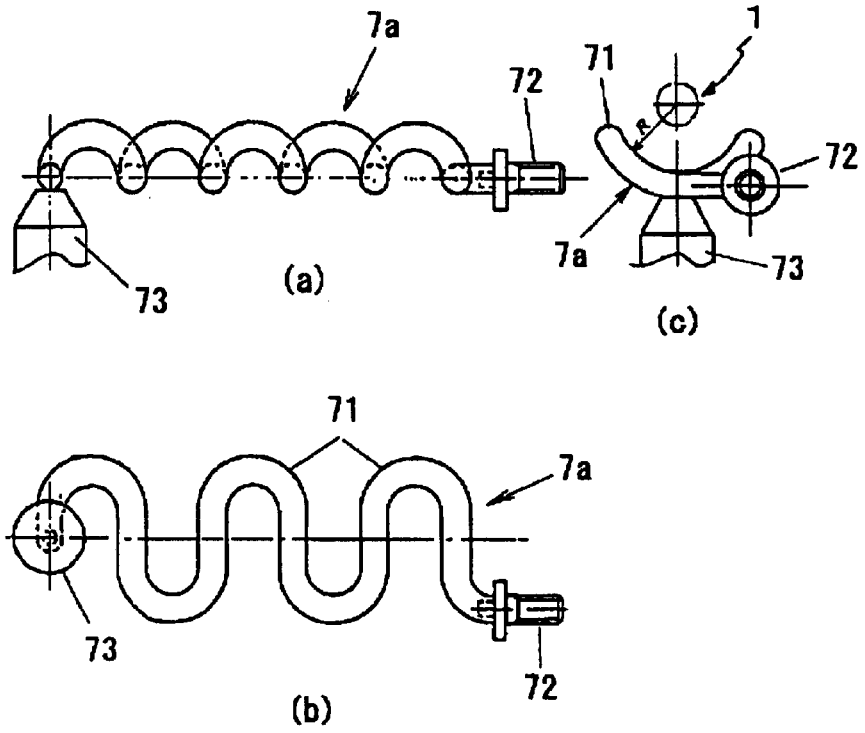
FIG. 5 show an elevation (a), a plan (b), and a side view (c) of an antenna in Another Embodiment in this invention.

As shown in an elevation (a), a plan (b), and a side view (c) in FIG. 5, antenna 7*a* is formed from a metal plate or a straight conductor to be a flat antenna by bending to a wave shape. This flat antenna is further bended to shape a circular face with around the same concentric circle as the electrode-less lamp 1 resulting in a waveform antenna body 71. Microwave energy is supplied with the microwave-generating source 5 to both ends 72 and 73 of the antenna body 71.

Figure 6:
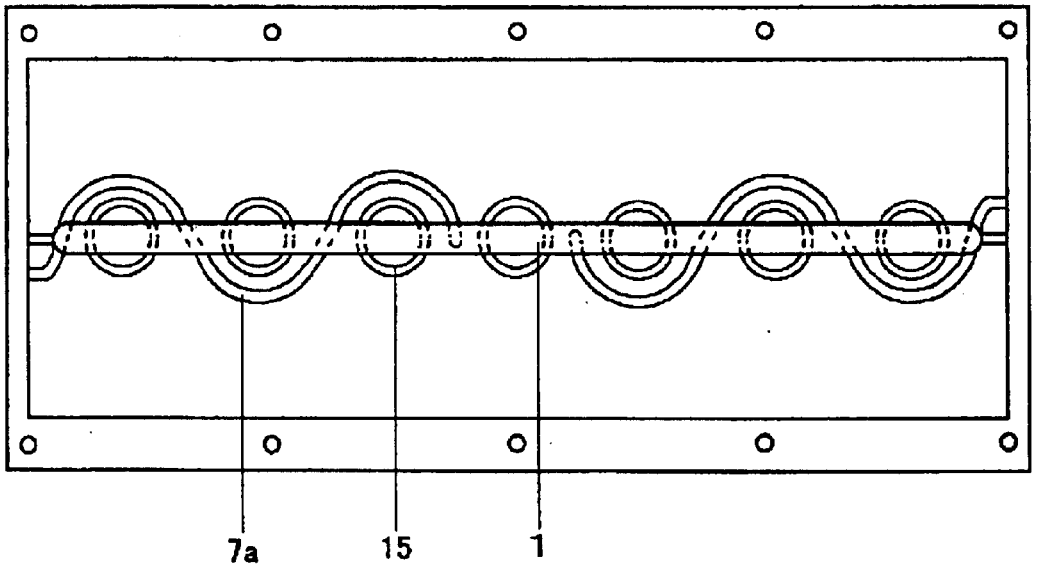
FIG. 6 shows an outline plan in bottom view of electrode-less lamp equipment in Another Embodiment in this invention.
Figure 7A:
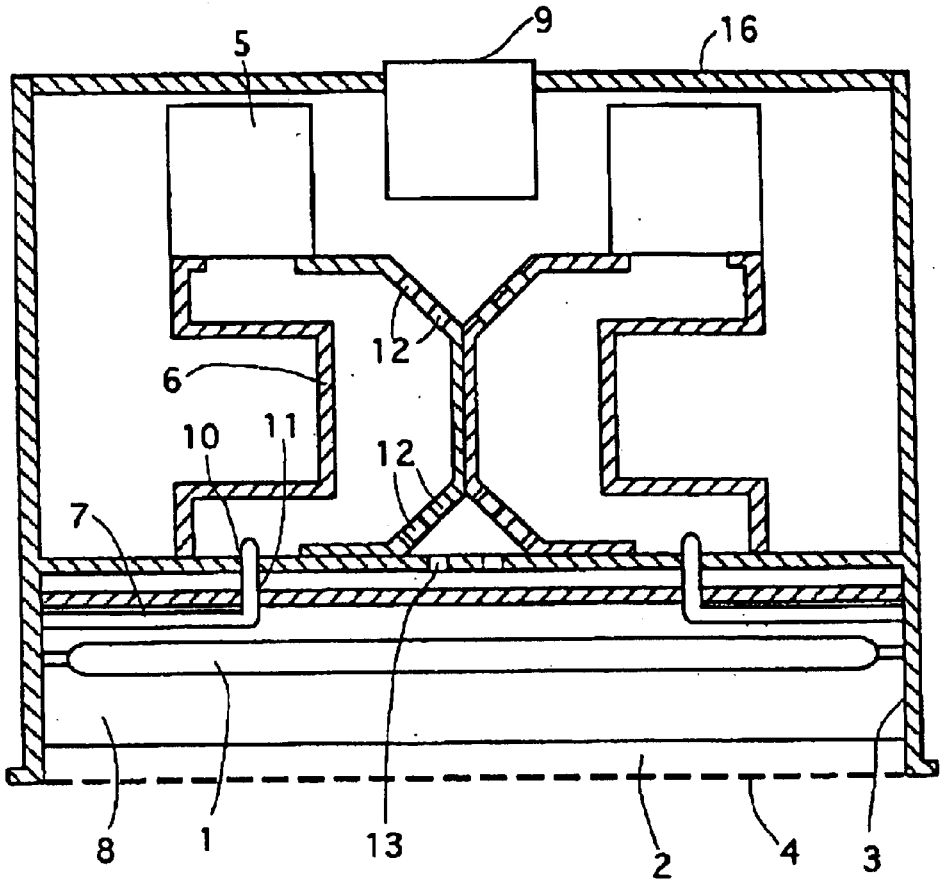
FIG. 7A PRIOR ART
FIGS. 7A and 7B show shows an example of electrode-less lamp equipment in the former arts.
Figure 7B:
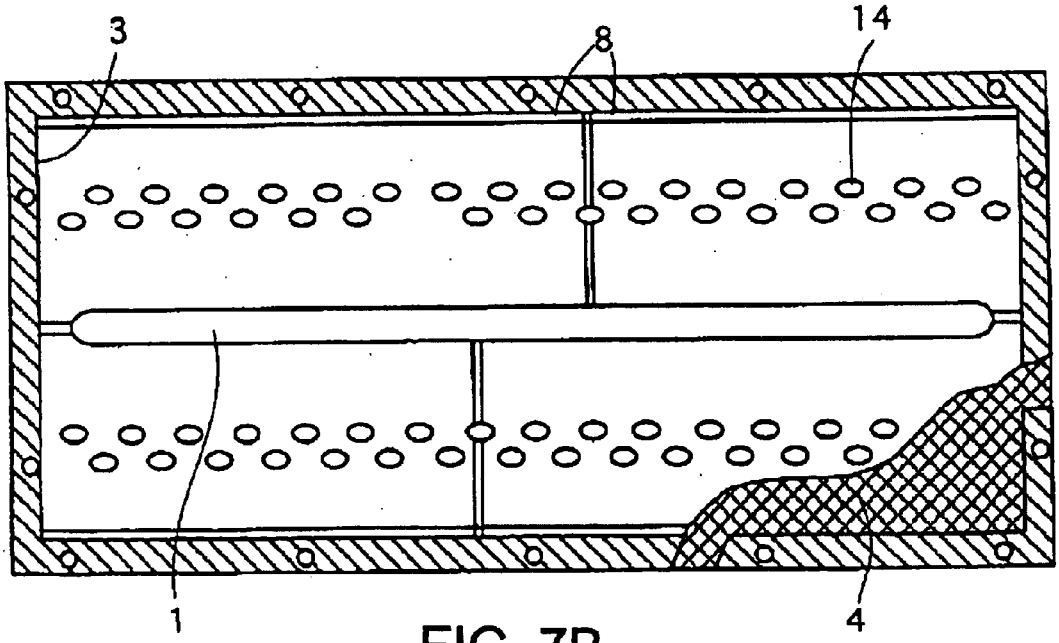
FIG. 7B PRIOR ART
Figure 8:
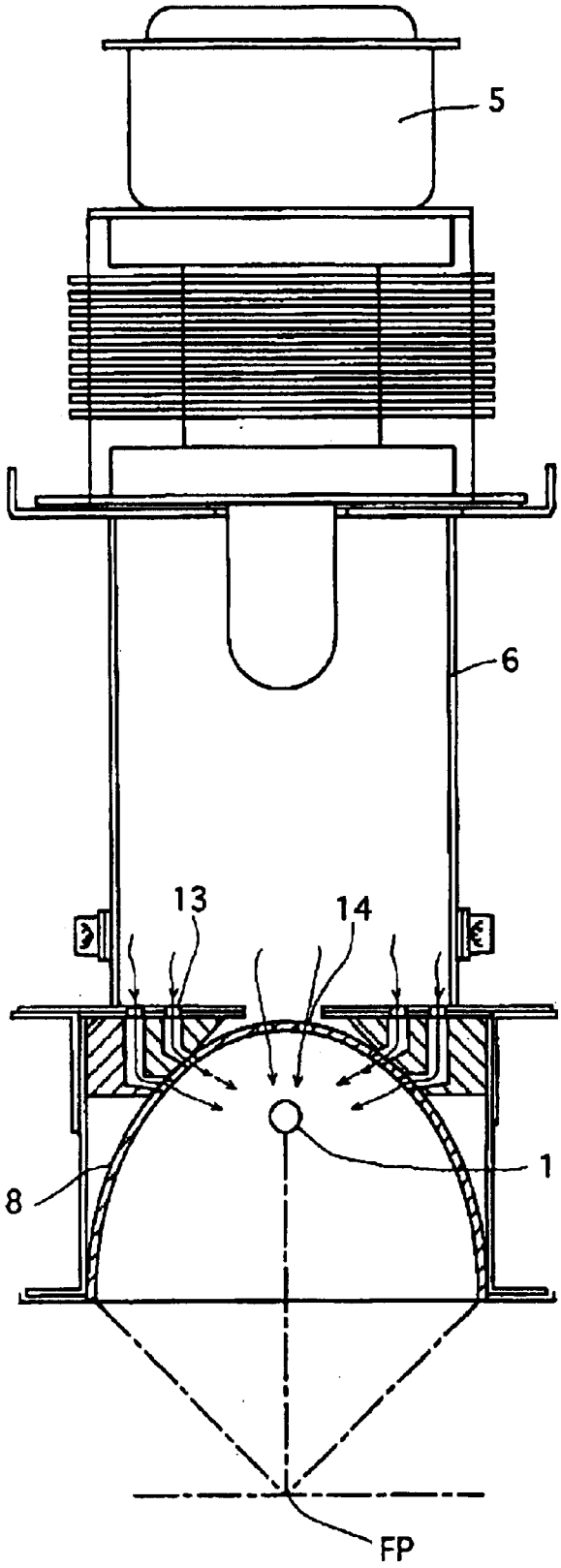
FIG. 8 PRIOR ART
FIG. 8 is a vertical section view that shows the coupling relationship between a microwave generating source, a waveguide, and a microwave chamber of the electrode-less lamp equipment in the former arts.

As shown in FIG. 5, both ends 72 and 73 are arranged with the antenna body 71 so that the end 73 is extended with right angle from the waveform antenna body 71 to waveguide 6 and is connected to the coaxial waveguide converter of the waveguide 6 that is not present in the Figure. The end 72 is extended in longitudinal direction to the chamber wall 3 of microwave chamber 2 and is connected electrically and mechanically. As shown in FIG. 6, where the antenna 7*a* is set, the lamp-cooling nozzles 15 are arranged with the same bending pitch as the waveform antenna body 71. Where the antenna 7*a* is not set, it is enough if an appropriate number of nozzles 15 considering cooling efficiency.

APPLICATIONS IN INDUSTRY

As described above, this invention provides with ventilation nozzles closer to the electrode-less lamp, which enhances cooling-air velocity around the electrode-less lamp. This nozzle allocation in this invention improved lamp-cooling efficiency and enabled higher input-power density resulting in higher luminance or less cooling airflow at no more luminance.

The invention being thus described, it will be obvious that the same may be varied in many ways. Such variations are not to be regarded as a departure from the spirit and the scope of the invention, and all such modifications as would obvious to one skilled in the art intended to be included within the scope of the following claims.

What is claimed is:

1. Electrode-less lamp equipment comprising: a microwave-generating source, a microwave chamber receiving the microwave through an antenna from the microwave-generating source, a bar-shaped electrode-less lamp in the microwave chamber, a halt-cut cylinder-shaped concave mirror that collects the light beam from the lamp, and airflow-spouting ventilation nozzles mounted closely to and distributed along a majority of the length of the bar-shaped electrode-less lamp for cooling said lamp, wherein said ventilation nozzles are extended from the concave bottom of said concave mirror to a close position of said electrode-less lamp.

2. The electrode-less lamp equipment described in claim 1 wherein the ventilation nozzles are substantially transparent for visual lights and microwaves.

3. An electrode-less lamp equipment comprising: a microwave-generating source, a microwave chamber receiving the microwave through an antenna from the generating source, a bar-shaped electrode-less lamp in the microwave chamber, a half-cut cylinder shaped concave mirror that collects the light beam from the lamp, wherein the antenna is arranged outside the bar-shaped electrode-less lamp and has a waveform shape formed from a bent conductive metal plate or a linear conductive material; and an array of ventilation nozzles arranged among bends of said waveform-shaped antenna, distributed along a majority of the lamp's length, and extending from the bottom of said concave mirror close to said electrode-less lamp.

4. The electrode-less lamp equipment described in claim 3 wherein the waveform-shaped antenna arranged outside the bar-shaped electrode-less lamp is formed as a concave shape at least partially enclosing said lamp in a plane crossing with right angle with longitudinal direction of said lamp.

* * * * *